US006716487B1

(12) United States Patent
Song

(10) Patent No.: US 6,716,487 B1
(45) Date of Patent: Apr. 6, 2004

(54) DECORATIVE STICKERS FROM INKJET PRINTING AND METHOD THEREFOR

(76) Inventor: Sang G. Song, c/o Donald B. Kang 7318 Quill Dr., Unit #25, Downey, CA (US) 90242

( * ) Notice: Subject to any disclaimer, the term of this patent is extended or adjusted under 35 U.S.C. 154(b) by 0 days.

(21) Appl. No.: 09/422,025

(22) Filed: Oct. 20, 1999

(51) Int. Cl.[7] ..... H05H 1/00

(52) U.S. Cl. ..... 427/535; 427/127; 427/143; 427/146; 427/551; 427/558; 427/598; 428/343

(58) Field of Search ..... 427/127, 143, 427/146, 551, 535, 558, 598, 147, 152; 428/343, 42, 41, 40.1, 207, 354, 422, 447; 101/123, 126; 219/216

(56) References Cited

U.S. PATENT DOCUMENTS

| | | | | |
|---|---|---|---|---|
| 4,038,123 A | | 7/1977 | Sammis | 156/240 |
| 4,137,842 A | | 2/1979 | Miller | 101/128 |
| 4,517,893 A | | 5/1985 | Wile et al. | 101/123 |
| 4,671,174 A | | 6/1987 | Tartaglia et al. | 101/115 |
| 4,844,849 A | | 7/1989 | Miller et al. | 264/46.4 |
| 5,021,275 A | | 6/1991 | Kim | 428/42 |
| 5,169,681 A | | 12/1992 | Kim | 427/147 |
| 5,952,429 A | * | 9/1999 | Ikeda et al. | 525/326.1 |
| 6,403,528 B1 | | 6/2002 | Shackle et al. | 503/201 |
| 6,449,774 B1 | * | 9/2002 | Michael | 2/311 |

FOREIGN PATENT DOCUMENTS

| | | |
|---|---|---|
| DE | 901793.6 | 5/1992 |
| ES | 9101833 | 6/1991 |
| FR | 2645472 | 12/1993 |
| GB | 2230492 | 1/1992 |
| GR | 2000928 | 12/1997 |
| JP | 58-13682 | 1/1983 |
| JP | 63-75081 | 4/1988 |
| JP | 63-194949 | 8/1988 |
| JP | 1-250985 | 10/1989 |
| JP | 2-284979 | 11/1990 |
| JP | 3-75671 | 12/1991 |
| JP | 4-29841 | 1/1992 |
| JP | 3019191 | 10/1995 |
| JP | 08272295 | 10/1996 |
| JP | 10180973 | 7/1998 |
| KR | 0029752 | 9/1985 |
| KR | 051069 | 4/1992 |
| KR | 056533 | 6/1992 |
| KR | 071676 | 3/1993 |
| KR | 070276 | 7/1993 |
| KR | 134305 | 4/1996 |
| KR | 101193 | 6/1996 |
| KR | 159054 | 8/1998 |

* cited by examiner

*Primary Examiner*—Terressa Boykin
(74) *Attorney, Agent, or Firm*—Park & Sutton LLP; John K. Park

(57) ABSTRACT

An article of manufacture for the construction of environmentally compatible stickers which are decorated using inkjet printing methods comprising a polymer plastisol biodegradable rubber resin as its primary ingredient to form one layer from bonding multiple layers. This removable/reusable sticker can even be used for preventing slippery in bathtub. And it is environmental friendly because of its biodegradable character when discarded. The inkjet printing method application is also effective in reducing number of manufacturing steps or processing stages to create vibrant custom inkjet produced images all at a relatively low cost.

11 Claims, 1 Drawing Sheet

Manufacturing Process

1. Silicon Coated Paper
2. Polymer Adhesive Layer
3. Biodegradable Plastisol Film Layer
4. Inkjet Printing Image Layer (Multiple Color)
5. Plastisol Embossing Layer

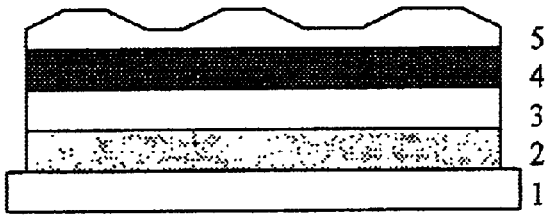

Manufacturing Process

1. Silicon Coated Paper
2. Polymer Adhesive Layer
3. Biodegradable Plastisol Film Layer
4. Inkjet Printing Image Layer (Multiple Color)
5. Plastisol Embossing Layer

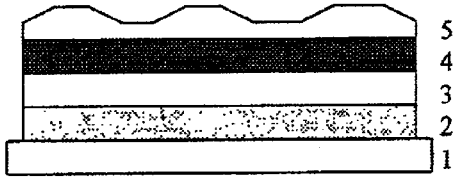

Fig. 1

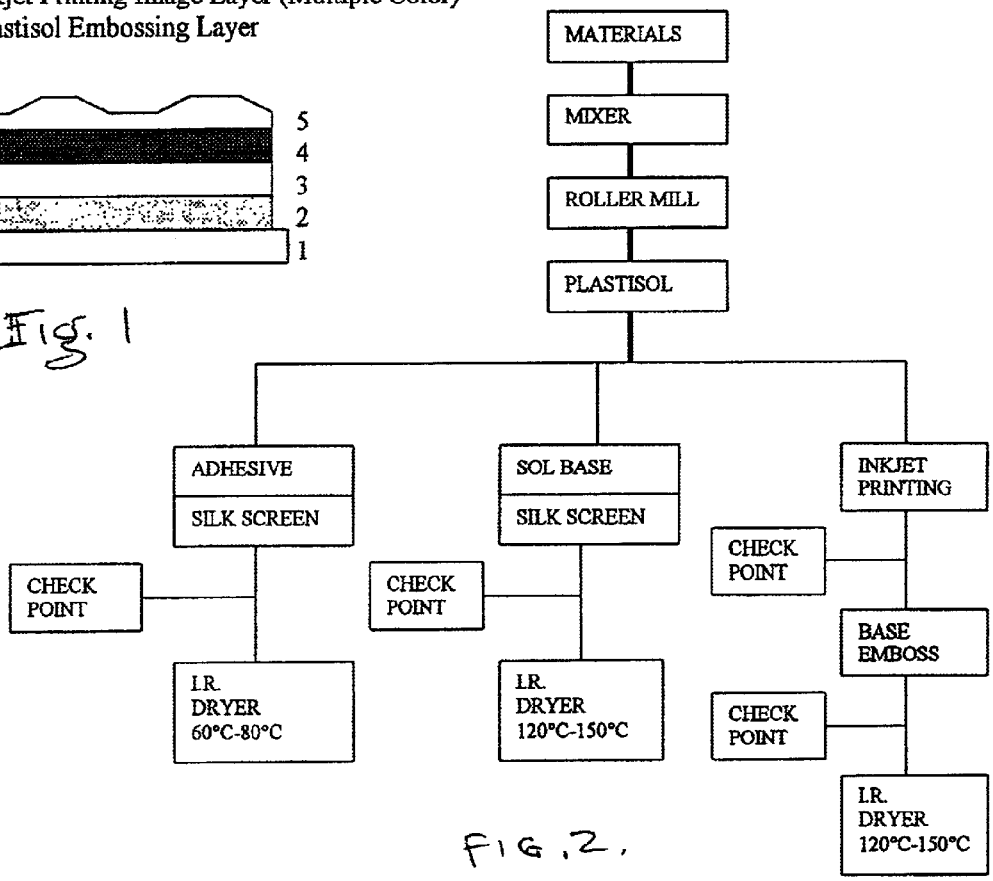

FIG. 2.

Effects of Invention

Presented invention, adhesive decorative sticker, posses many ingenious characteristics. Its silicon coated base paper does not leave any residue on the sticker and the sticker itself does not leave any residue on the attaching surfaces when removed, yet retains strong adhesive property. Hence, the sticker is removable and reusable. The sticker's ingredient such as rubber plastisol film layer has exceptional bonding quality, thereby maintaining the excellent structural stability and superb elasticity. Also, the sticker's unique printing medium allows all kinds of photo-quality image printing with inkjet print method. The sticker can be manufactured cost-effectively, making it ideal for small quantity sample productions to mass production. Its versatile attributes can be used in countless applications in various types of industries.

DECORATIVE STICKERS FROM INKJET PRINTING AND METHOD THEREFOR

BACKGROUND OF THE INVENTION

1. Field of the Invention

The present invention relates to the manufacture of stickers, and the like, and, more specifically, to environmentally compatible, biodegradable stickers with vibrant colors and decorations thereon applied by inkjet printer methods.

2. Description of the Related Art

In the relatively conventional method of producing such articles of manufacture, such as stickers, silk screen printing technology is used to apply an adhesive layer on silicon coated paper, then using silkscreen printing to apply another layer of plastisol thereto. Then, the combination must be treated using a relatively high temperature heat blower to the combination.

One of the typical problems encountered in this prior art article of manufacture and the method for accomplishing it was that the heating process would not create one bonded layer. Consequently, the adhesive layer used to bond the sticker to another surface was not removable and reusable. As a result, some adhesive residue was left behind on the surface to which the sticker was adhesively attached to which was undesirable since the adhesive residue left on the surface had to be somehow removed. Oftentimes, merely scrubbing with water, or soap and water, did not remove the adhesive residue. If petrochemical liquids, such as nail polish remover (typically acetone), alcohol, paint thinner, methyl ethyl ketone (MEK), turpentine, white (unleaded) gasoline, trichioroethylene (TRIC), or the like, would have to be used to remove the undesirable adhesive residue. Use of such petrochemical solvents oftentimes reacts harshly with colored materials by either removing some (or all) of the coloring from the material, or causes damage to the materials.

Additionally, use of the prior art method often produced irregularities in color, color brightness, contrast, imperfect bonding of between the adhesive and the plastisol resulted in image distortion of the decorative design especially when the sticker was removed from the original surface it was adhesively bonded to. When such occurs the sticker is not usually considered reusable, and, hence, is tossed in the trash.

In the prior art, the silk screen process is used to create images on a resin layer. This is the method typically used on conventional printed ceramic tiles and in printing on, and in the use of vinyl printing. However, this prior art technique oftentimes does not produce ideal products due to inconsistency in the nature of the silk screen production processes. Consequently, this method is often considered to be not feasible for even small quantity production runs and due to its relative high cost especially since it is labor-intensive.

Conventionally, images are printed on heat treated PVC (polyvinyl chloride) layer that was silk screen printed on top of a silk screen printed and applied adhesive material. However, these layers are prone to color fade and dullness as well as producing serious environmental pollution issues due to the non-biodegradable toxic character of the materials used.

The net results is that the present invention overcomes significant portions of the problems found in the use of prior art processes and methods.

BRIEF DESCRIPTION OF THE INVENTION

The invention described herein consists of both an article of manufacture and the method for making such article, including an article of manufacture for the construction of environmentally compatible stickers which are decorated using inkjet printing methods comprising a polymer plastisol biodegradable rubber resin as its primary ingredient to form one layer from bonding multiple layers. This removable/reusable sticker can even be used for preventing one from slipping in the bathtub. It is environmental friendly because of it is biodegradable. When the sticker is discarded, it simply biodegrades and becomes a genuine part of the landscape. The inkjet printing method application is also effective in reducing multiple numbers of manufacturing steps or processing stages to simply one in order to create vibrant custom inkjet produced images all at a relatively low cost.

The new article of manufacture for the production of stickers, and the like, involves the use of silicon coated paper. The printable side of the silicon coated paper is treated with a mixture of glue comprised of acrylic polymer binder and DOP (dioctyl phthalate) in order to give it a non-slippery texture. A removable and reusable decorative sticker is formed by screen printed adhesive layer and polymer plastisol—which is formed typically be a mixture of acrylic polymer binder, starch, PVC and DOP—layer which is then heated through infrared (I.R.) conveyor type dryer to produce a single, bonded layer of material.

In another embodiment of the invention, there is a silicon coated paper having printable side treated with a mixture of glue comprised of acrylic polymer binder and dioctyl phthalate (DOP) producing a slippery textured surface.

Another embodiment of the present invention is a removable and reusable decorative sticker formed by silk screen printed adhesive layer and polymer plastisol formed of a mixture of acrylic polymer binder, starch, polyvinyl chloride (PVC) and dioctyl phthalate (DOP), and then passed through an infrared (I.R.) conveyor dryer to form one bonded layer.

Another embodiment of the present invention is a decorative sticker with real-life-like photo image thereon manufactured using the inkjet printing process rather than the silk-screen printing process which involves several number of complex processing stages.

The previously described versions of the present invention has many advantages which include that the new article of manufacture and the method for producing such discovered by me enables stickers to be make which are both removable and reusable. No adhesive residue is left on the surface to which the sticker is adhesively attached.

A further advantage is that this process prevents ink from bleeding, smear, or spread with the use of the fast drying, small inkjet droplets used in modem inkjet printing technology. Consequently, by the use of this product and process for producing this article of manufacture, the applications are vastly increased and virtually any kind of images can be applied in the construction of the stickers. The resultant sticker construction retains excellent bonding and water resistant and scratch resistant properties, yet it maintains its elasticity as well. It also is used in creating any type of images perfectly using conventional inkjet printing methods. Use of the Inkjet printing method completely eliminates the multiple processing stages of silk screen printing and converts it down to just one stage. As a result, a new, improved sticker is constructed which is also low in cost, removable and reusable.

A still further advantage, this new and unique product is also biodegradable because of the use of its ingredient, namely: polymer starch plastisol, which is added in during the emboss processing stage for protection and preservation of the inkjet produced image. Not only does it protect and preserve, but it also greatly reduces color fade and sliding prevention.

Another advantage is to produce a decorative sticker having real life-like photo images such can be manufactured or produced using the inkjet process. The application of real lifelike photo images was not possible using silk screen processes which typically involve a multiple number of complicated processing stages which is expensive and imprecise resulting in a large variation of quality products.

BRIEF DESCRIPTION OF THE DRAWINGS

These and other features, aspects and advantages of the present invention will become better understood with reference to the following description, appended claims and accompanying drawings where:

FIG. 1 shows a cross-section of an embodiment of a sticker according to the present invention and FIG. 2 shows a flow chart of a method according to the present invention.

DETAILED DESCRIPTION OF THE INVENTION

This invention focuses on resolving the problems stemming from conventional methods. New process enables stickers to be removable and reusable with no residue left on attaching surface. Furthermore, this process prevents ink from spreading with inkjet printing application and any kind of images can be expressed.

This invention utilizes polymer plastisol biodegradable rubber resin as its primary ingredient to make one layer from bonding multiple layers. This removable/reusable sticker can be used for preventing slipping in a bathtub. And it is environmental friendly because of its biodegradable character when discarded. Inkjet printing method application is also effective in reducing number of processing stages and creating vibrant images at low cost.

With continued reference now to all of the drawings herein, there is shown both the new and unique article of manufacture and the method for making same.

Referring to FIG. 1, a sticker manufactured according to an embodiment of the present invention has the following layered construction:

1. Silicon Coated Paper
2. Polymer Adhesive Layer
3. Biodegradable Plastisol Film Layer
4. Inkjet Printing Image Layer (Multiple Color)
5. Plastisol Embossing Layer This invention, upon much effort in research and development, applied excellent bonding properties of DOP. Removable and reusable layer is achieved primarily by bonding of DOP and adhesive through mixture of flop and acrylic polymer adhesive binder, 80:20 ratio, screen printed on silicon coated paper, which is then passed through infrared (I.R.) conveyor dryer.

On top of adhesive plastisol layer, removable/reusable and transparent rubber plastisol film-like sheet is created with mixture of plastisol (PVC & DOP), acrylic polymer rubber resin and biodegradable starch resin, 80%, 10%, 0%, respectively, which is screen printed on top of adhesive layer and passed through I.R. Conveyor to bond.

There is the use of ink jet printing method on removable/reusable plastisol film layer to produce high resolution image and to reduce number of processing stages. Embossing layer is screen printed to prevent damage to the image and color fading. In order for ink from inkjet printer to print flawlessly, softener is added to removable/reusable film sheet creating excellent removable/reusable inkjet printing sheet to be used for various purposes.

There is a bonding process of creating one plastisol film layer, when passed through I.R. conveyor (bio ceramic heater), obtains heat-resistant, cohesion properties as well as exceptional chemical mixture and superior absorption of inkjet ink to print desired high quality image. Temperature Of the I.R. conveyor varies in each stage from 120° C. to 150° C. for duration of 90 seconds.

Referring to FIG. 1, there is illustrated a cross-section of a sticker in accordance with an embodiment of the present invention. The figure shows the following:

A) Adhesive Layer (2) is screen printed on Silicon Coated Paper (1) then is heat dried, B) Plastisol Film Layer (3) is produced by screen printing polymer plastisol rubber resin, which is biodegradable and water & heat resistant, then is heat dried.

C) image (4) is printed by inkjet printing method

D) Embossing (5) is done by screen print and then heat dried.

The present invention of an adhesive decorative sticker posses many ingenious characteristics. Its silicon coated base paper does not leave any residue on the sticker and the sticker itself does not leave any residue on the attaching surfaces when removed, yet retains strong adhesive property. Hence, the sticker is removable and reusable, The sticker's ingredient such as rubber plastisol film layer has exceptional bonding quality, thereby maintaining the excellent structural stability and superb elasticity. Also, the sticker's unique printing medium allows all kinds of photo quality image printing with inkjet print method, The sticker can be manufactured cost-effectively, making it ideal for small quantity sample productions to mass production. Its versatile attributes can be used in countless applications in various types of industries.

An advantage of the present invention is that the sticker produced is both removable and reusable, and it leaves no adhesive residue on the surface to which it was attached to when the sticker is removed.

By the use of the inkjet printing process, the sticker can produce photo images conventionally not possible with silk screen process. Utilizing the ability to put any type of desired image, the sticker can be used for various type of applications, such as decorating kitchens, bathroom, window, ceramic tiles and as auto bumper stickers, and for indoor/outdoor advertisements.

Another advantage of the present invention is that the sticker retains excellent bonding and water & scratch resistant properties, yet it maintains elasticity as well as creating any type of images perfectly using inkjet printing method. Inkjet printing method eliminates multiple processing stages of silk screen printing to just one stage, therefore enabling low cost removable and reusable stickers for consumers.

Still another advantage of the present invention is This product is also biodegradable because of its ingredient, polymer starch plastisol, added in emboss processing stage for image protection, and color fade and sliding prevention.

EXAMPLE

1. Production 1

Acrylic polymer binder adhesive 80% and DOP 20% along with 5% of catalyst is mixed in stirrer. This mixture is put onto silicon coated paper by silk screen print method and is heat dried through .R. conveyor (60° C. 80° C., 90 seconds), yielding adhesive layer, Uniformly even thickness of dried adhesive layer is maintained by measuring with thickness gauge.

2. Production 2

Plastisol (PVC 20%, DOP 30%) 50%

Acrylic polymer binder rubber resin 20%

Biodegradable starch resin 20%

Catalyst 10%

Above ingredients are mixed in orderly fashion and processed with Three Roll Mill 3 times to make rubber plastisol.

3. Production 3

Image printed from inkjet printing method attains high resolution and unique texture, which is not possible with images created by silk screen print method.

4. Production 4

Final embossing gives various texture and unique color promotion to the decorative, removable and reusable sticker.

What is claimed is:

1. A method of making a removable and reusable decorative sticker comprising the steps of:

a. silk screening to form a print on a combination of an adhesive layer and polymer plastisol formed of a mixture of acrylic polymer binder, starch, polyvinyl chloride and dioctyl phthalate and then b. passing the combination by conveyor means through an infrared heated dryer and forming thereby a single bonded layer.

2. A method of making a decorative sticker with a real-life-like photo image thereon, comprising the steps:

a. inlkjet printing to form an image on a combination of an adhesive layer and polymer plastisol formed of a mixture of acrylic polymer binder, starch, poly vinyl chloride and dioctyl phthalate and then b. passing the combination by conveyor means through an infrared heated dryer and forming thereby a single bonded layer.

3. A sticker construction comprising the combination of:

a. a silicon coated paper;

b. a polymer adhesive layer;

c. biodegradable plastisol film layer;

d. an inkjet printed image layer and e. a plastisol embossing layer.

4. A sticker construction comprising the combination of:

a. a silicon coated paper;

b. a polymer adhesive layer applied to the silicon coated paper;

c. a biodegradable plastisol film layer consisting of a mixture of:

(i.) twenty percent by weight of polyvinyl chloride;

(ii.) thirty percent by weight of dioctyl phthalate;

(iii.) twenty percent by weight of acrylic polymer binder rubber resin;

(iv.) twenty percent by weight of starch resin and (v.) ten percent by weight of resin catalyst;

d. a inkjet printed image layer and c. a plastisol embossing layer.

5. A sticker construction comprising:

a. a silicon-coated paper forming the base of the sticker, said base having a top portion and a bottom portion;

b. a polymer adhesive layer, said polymer adhesive layer having a top portion and a bottom portion, wherein said bottom portion is bonded to the top portion of said base;

c. a biodegradable plastisol film layer, said plastisol film layer having a top portion and a bottom portion, wherein said bottom portion is bonded to the top portion of said polymer adhesive layer;

d. a inkjet printed image layer, said image layer having a top portion and a bottom portion, wherein said bottom portion is bonded to the top portion of said biodegradable plastisol film layer and e. a plastisol embossing layer, said plastisol embossing layer having a top portion and a bottom portion, wherein said bottom portion is bonded to the top portion of said inkjet printed image layer.

6. A method of sticker construction, comprising the steps of:

a. coating the printable side of a sheet of silicon coated paper with a mixture of glue consisting of acrylic polymer binder and dioctyl phthalate to produce a non-slippery texture;

b. drying said mixture of glue consisting of acrylic polymer binder and dioctyl phthalate;

c. applying an adhesive layer and polymer plastisol to the printable side of a sheet of silicon coated paper;

d. heating said adhesive layer and polymer plastisol to bond said adhesive layer and polymer plastisol to said glue acrylic polymer binder and dioctyl phthalate;

e. applying a mixture of 80% by weight of plastisol, 10% by weight of acrylic polymer rubber resin and 10% by weight of biodegradable starch resin to said adhesive layer and polymer plastisol bonded to the printable side of a sheet of silicon coated paper;

f. heating said mixture of plastisol, acrylic polymer rubber resin and biodegredable starch resin applied to said adhesive layer and polymer plastisol to bond with said mixture and adhesive layer and polymer plastisol;

g. applying an image by inkjet printing to said plastisol, acrylic polymer rubber resin and biodegradable starch resin;

h. embossing said image created by inkjet printing by applying a polymer starch plastisol to said image created by inkjet printing to protect and preserve said image and i. heating the polymer starch plastisol to fix the embossing.

7. The method of sticker construction of claim 6 wherein the step of drying said mixture of glue consisting of acrylic polymer binder and dioctyl phthalate by heating said mixture of glue consisting of acrylic polymer binder and dioctyl phthalate to a temperature from 60 to 80 degrees Centigrade for a period of about ninety seconds.

8. The method of sticker construction of claim 6 wherein the step of applying an adhesive layer and polymer plastisol to the printable side of a sheet of silicon coated paper is accomplished by the process of silk screening printing said adhesive layer and polymer plastisol to the printable side of a sheet of silicon coated paper.

9. The method of sticker construction of claim 6 wherein the step of applying a mixture of 80% by weight of plastisol 10% by weight of acrylic polymer rubber resin and 10% by weight of biodegradable starch resin to said adhesive layer and polymer plastisol bonded to the printable side of a sheet of silicon coated paper is accomplished by the process of silk screen printing.

10. The method of sticker construction of claim 6 wherein the step of heating said adhesive layer and polymer plastisol to bond said adhesive layer and polymer plastisol to ad glue acrylic polymer binder and dioctyl phthalate is accomplished by heating said adhesive layer and polymer plastisol to bond said adhesive layer and polymer plastisol to said glue acrylic polymer binder and dioctyl phthalate to a temperature from 120 degrees to 150 degrees Centigrade until bonding occurs.

11. The method of sticker construction of claim 6 wherein the step of beating the polymer starch plastisol to fix the embossing to a temperature in the range of between 120 degrees and 150 degrees Centigrade.

* * * * *